US011313260B1

(12) United States Patent
Chen et al.

(10) Patent No.: US 11,313,260 B1
(45) Date of Patent: Apr. 26, 2022

(54) ENGINE HAVING CYLINDER BLOCK CASTING WITH OIL SPRAY JET GALLERY AND OIL ADMISSION VALVE FOR SELECTIVE OIL JET SPRAYING TO CYLINDERS

(71) Applicant: Caterpillar Inc., Peoria, IL (US)

(72) Inventors: Allen Yao Chen, Dunlap, IL (US); Samuel Jaroslav Stafl, Peoria, IL (US); Chad Palmer Koci, Washington, IL (US); Thomas L. Atwell, Maryville, TN (US); Andrew David Schick, Edelstein, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/211,103

(22) Filed: Mar. 24, 2021

(51) Int. Cl.

| | |
|---|---|
| ***F01M 1/08*** | (2006.01) |
| ***F01M 1/16*** | (2006.01) |
| ***B05B 1/30*** | (2006.01) |
| ***F02B 75/20*** | (2006.01) |

(52) U.S. Cl.
CPC ..... *F01M 1/08* (2013.01); *B05B 1/3026* (2013.01); *F01M 1/16* (2013.01); *F02B 75/20* (2013.01)

(58) Field of Classification Search
CPC ..... F01M 1/08; F01M 1/16; F01M 2001/083; F01M 2001/086; B05B 1/3026; F02B 75/20
See application file for complete search history.

(56) References Cited

U.S. PATENT DOCUMENTS

| | | | | |
|---|---|---|---|---|
| 5,267,534 | A | 12/1993 | Berlinger | |
| 2013/0206083 | A1 | 8/2013 | Wood | |
| 2015/0377115 | A1* | 12/2015 | Shinagawa | F02D 41/221 123/41.15 |

FOREIGN PATENT DOCUMENTS

| | | | |
|---|---|---|---|
| DE | 102017212547 | A1 | 1/2019 |
| JP | 2007032416 | A | 2/2007 |
| JP | 2013144947 | A | 7/2013 |

* cited by examiner

*Primary Examiner* — Jacob M Amick
(74) *Attorney, Agent, or Firm* — Brannon Sowers & Cracraft

(57) ABSTRACT

An engine includes a cylinder block having formed therein a plurality of cylinders, a main oil gallery, and a spray jet gallery. A cross-hole is fluidly connected to the main oil gallery and extends to the spray jet gallery. Oil spray jets are each fluidly connected to one of a plurality of oil feed holes fluidly connected to the spray jet gallery. An oil admission valve, which can be hydraulically actuated or electrically actuated, is supported in the cylinder block and movable between a closed position to block the spray jet gallery and each of the oil feed holes from the cross-hole, and an open position.

19 Claims, 5 Drawing Sheets

ENGINE HAVING CYLINDER BLOCK CASTING WITH OIL SPRAY JET GALLERY AND OIL ADMISSION VALVE FOR SELECTIVE OIL JET SPRAYING TO CYLINDERS

TECHNICAL FIELD

The present disclosure relates generally to an internal combustion engine, and more particularly to an oil admission valve supported in a cylinder block and movable to open and close a spray jet gallery formed in the cylinder block.

BACKGROUND

Internal combustion engines typically include a plurality of reciprocating pistons within combustion cylinders in a cylinder block. Combustion of a mixture of air and fuel causes the pistons to move in response to a rapid pressure and temperature rise in the combustion cylinders to rotate a crankshaft. Internal combustion engines commonly operate on a four-stroke cycle including an intake stroke of the pistons, a compression stroke, an expansion stroke, and an exhaust stroke. Various engine configurations alternatively employ a two-cycle pattern.

The combustion of fuel and air generates heat within the combustion cylinders that is transferred to the metallic surfaces of the engine, including cylinder or cylinder liner walls, the pistons, an engine head, etc. Various strategies for dissipating heat of combustion include conveyance of liquid coolant through the cylinder block, as well as conveyance of oil to surfaces of the pistons and associated apparatus.

In some internal combustion engines, notably compression-ignition diesel engines, piston cooling jets are commonly positioned below the pistons to spray engine oil at the pistons in order to keep the pistons from overheating. Engines traditionally utilize a fixed displacement oil pump that operates linearly in relation to engine speed. As a result, the oil pressure that is provided to spray cooling oil by way of the piston cooling jets can vary with pump and engine speed. When an engine is operating at a higher engine load, the heat of combustion can be sufficient that piston cooling by way of piston cooling jets is indispensable to operation. In other instances, the need for oil spray may be much reduced. Certain attempts have been made to regulate piston cooling jet spray to avoid wasting energy by way of wasted oil pressure and oil consumption when the need for piston cooling is reduced. One such strategy utilizes ball-spring check valves in each individual jet. This strategy can impact flow characteristics of oil conveyed through the jet, sometimes undesirably.

One known piston cooling jet configuration is known from U.S. Pat. No. 5,267,534 to Berlinger. In Berlinger a cooling nozzle includes a non-metallic body and a metallic insert. A passage configuration through the cooling nozzle apparently provides a smooth, reduced turbulence and reduced eddy flow pattern. The cooling nozzle is stated to be low cost and efficient. While the cooling jet/nozzle configuration of Berlinger undoubtedly has applications, there is always room for improvement and development of alternative strategies.

SUMMARY OF THE INVENTION

In one aspect, an engine includes a cylinder block having formed therein a plurality of cylinders extending between a top deck surface and a bottom block surface, and arranged between a front block end, and a back block end. The cylinder block further has formed therein a main oil gallery extending longitudinally between the front block end and the back block end, a spray jet gallery, a plurality of oil feed holes fluidly connected to the spray jet gallery, and a cross-hole fluidly connected to the main oil gallery and extending to the spray jet gallery. The cylinder block still further includes a plurality of oil spray jets each fluidly connected to one of the plurality of oil feed holes and oriented to spray oil upwardly into one of the plurality of cylinders, and an oil admission valve supported in the cylinder block and movable between a closed position where the oil admission valve blocks the spray jet gallery and each of the plurality of oil feed holes from the cross-hole, and an open position.

In another aspect, a cylinder block includes a cylinder block casting having formed therein a plurality of cylinders extending between a top deck surface and a bottom block surface, and arranged between a front block end, and a back block end. The cylinder block casting further has formed therein a main oil gallery extending longitudinally between the front block end and the back block end, a spray jet gallery extending longitudinally between the front block end and the back block end, a plurality of oil feed holes each opening from the spray jet gallery at a location longitudinally aligned with one of the plurality of cylinders, and a cross-hole fluidly connected to the main oil gallery and extending to the spray jet gallery. The cylinder block casting still further includes an outer casting surface, and a cast-in valve body forming a valve bore extending from the cross-hole to the outer casting surface.

In still another aspect, an engine includes a cylinder block having formed therein a plurality of cylinders extending between a top deck surface and a bottom block surface, and arranged between a front block end, and a back block end. The cylinder block further has formed therein a main oil gallery extending longitudinally between the front block end and the back block end, a spray jet gallery, a plurality of oil feed holes each fluidly connected to the spray jet gallery and longitudinally aligned with one of the plurality of cylinders, and a cross-hole fluidly connected to the main oil gallery and extending to the spray jet gallery. The cylinder block still further includes an oil admission valve supported in the cylinder block and movable between a closed position where the oil admission valve blocks the spray jet gallery and each of the plurality of oil feed holes from the cross-hole, and an open position.

DETAILED DESCRIPTION

Figure 1:
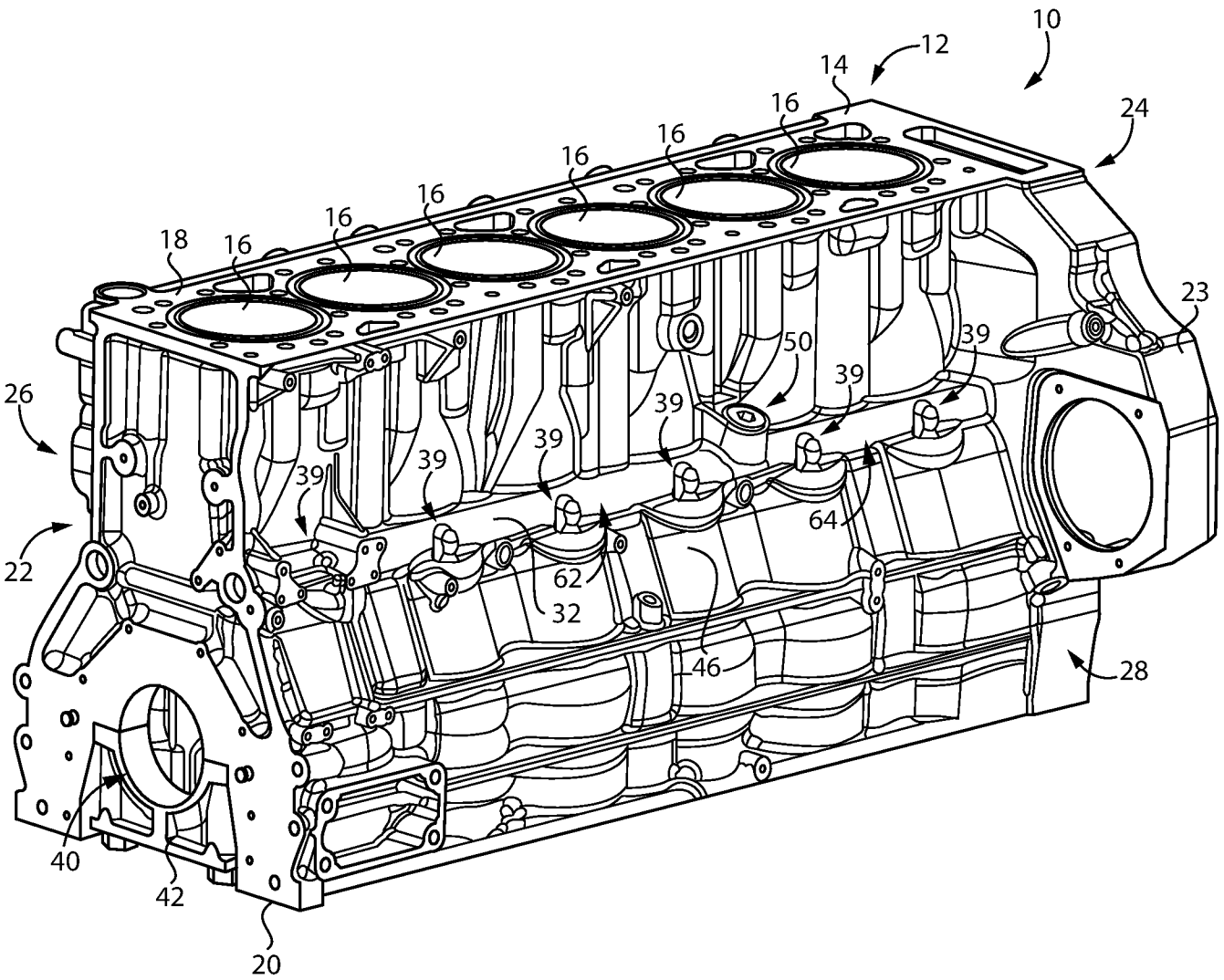
FIG. 1 is a diagrammatic view of a cylinder block casting in an engine, according to one embodiment.
Figure 2:
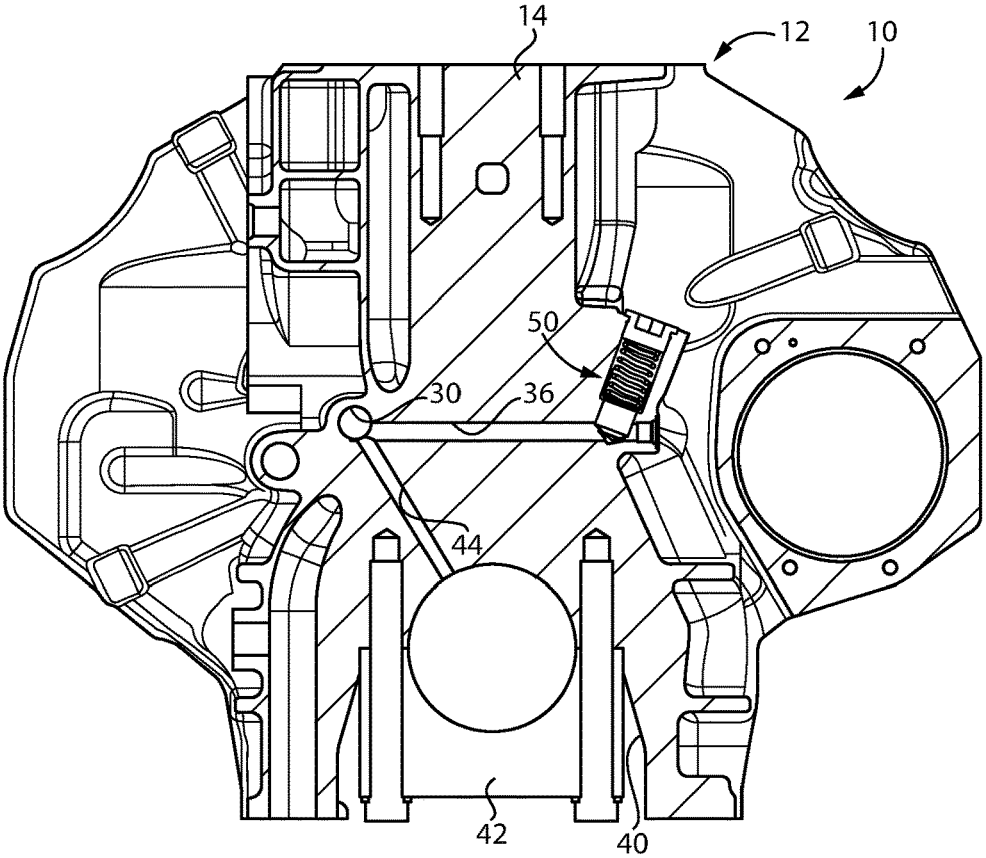
FIG. 2 is a sectioned view through a cylinder block casting as in FIG. 1.
Figure 3:
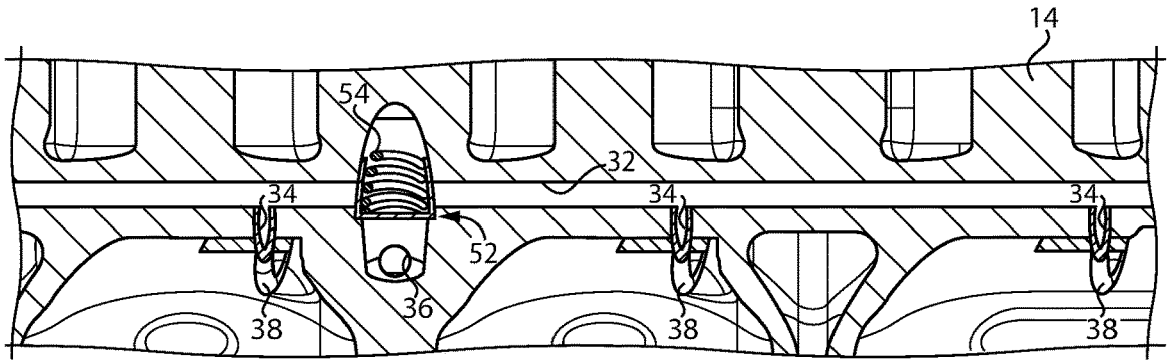
FIG. 3 is another sectioned view through a cylinder block casting as in FIG. 1.

Referring to FIG. 1, there is shown an internal combustion engine 10, according to one embodiment. Engine 10 includes a cylinder block 12 having a one-piece casting 14. Cylinder block 12 and cylinder block casting 14 are referred to interchangeably herein at times. Cylinder block 12 has formed therein a plurality of cylinders 16 extending between a top deck surface 18 and a bottom block surface 20. Cylinders 16 are arranged between a front block end 22, and a back block end 24. In the illustrated embodiment cylinders 16 are six in number and are in an inline arrangement between front block end 22 and back block end 24. In other embodiments, cylinders 16 could be in a different arrangement such as a V-pattern, and could be of any number. Cylinder block 12 further forms a crankcase 40, and a plurality of crank bearings 42 are coupled to cylinder block 12 to rotatably journal a crankshaft in a generally conventional manner. A first lateral side 26 of cylinder block 12 is shown at 26 and a second lateral side of cylinder block 12 is shown at 28. First lateral side 26 and second lateral side 28 can also be understood as opposite lateral sides of crankcase 40.

Although not illustrated in FIG. 1, those skilled in the art will appreciate that each of cylinders 16 may be equipped with a piston, the pistons being coupled with a crankshaft by way of connecting rods in a generally conventional manner. Engine 10 may also include a front gear train positioned at front block end 22 and a back gear train positioned at back block end 24, neither of which is illustrated. A front gear train could include a flywheel. A back gear train could include various gears for operating auxiliary equipment including a pump gear, a cam gear, and still others. A block flange 23 for mounting of gear train components is positioned at back block end 24. It should be appreciated that the terms "front" and "back" are used herein only in an illustrative sense, and should not be taken to require any particular orientation or arrangement of cylinder block 12 or associated components in engine 10. The positioning of components of a back gear train and a front gear train could be varied or reversed from that described. Engine 10 can be compression-ignited, structured to operate on a liquid fuel such as a liquid diesel distillate fuel that is directly injected by way of fuel injectors each positioned to extend into one of cylinders 16 and supported in an engine head. In other embodiments, engine 10 could be spark-ignited, prechamber-ignited, dual fuel liquid pilot-ignited, or have a variety of other configurations or operating strategies.

Referring also now to FIGS. 2-5, cylinder block 12 further has formed therein a main oil gallery 30 extending longitudinally between front block end 22 and back block end 24. Cylinder block 12 further has formed therein a spray jet gallery 32. Spray jet gallery 32 may also extend longitudinally between front block end 22 and back block end 24. Also in the illustrated embodiment main oil gallery 30 is upon first lateral side 26 of crankcase 40 and spray jet gallery 32 is upon second lateral side 28 of crankcase 40. A plurality of spray jet locations 39 are associated with a plurality of oil spray jets 38 each longitudinally aligned with one of cylinders 16 and structured to spray oil upwardly at or towards an underside of pistons within cylinders 16, as further discussed herein.

Cylinder block 12 further has formed therein a plurality of oil feed holes 34 fluidly connected to spray jet gallery 32, and a cross-hole 36 fluidly connected to main oil gallery 30 and extending to spray jet gallery 32. A total of one oil feed connection may extend between main oil gallery 30 and spray jet gallery 32 and is formed by cross-hole 36. Put differently, the sole fluid connection between main oil gallery 30 and spray jet gallery 32 may be one cross-hole 36. Also in the illustrated embodiment spray jet gallery 32 includes a forward segment 62 arranged to feed oil to a forward set of oil feed holes 34, and a back segment 64 arranged to feed oil to a back set of oil feed holes 34. Cross-hole 36 may be approximately half-way fore and aft between front block end 22 and back block end 24 and may fluidly connect to spray jet gallery 32 at a location that is longitudinally between the forward set of oil feed holes 34 and the back set of oil feed holes 34. Oil feed holes 34 may each be oriented so as to open downwardly from spray jet gallery 32. Oil feed holes 34 may be arranged on-center with the respective one of cylinders 16 in some embodiments, meaning a center axis of each oil feed hole 34 is substantially aligned fore and aft with a center axis of one of cylinder 16.

Figure 4:
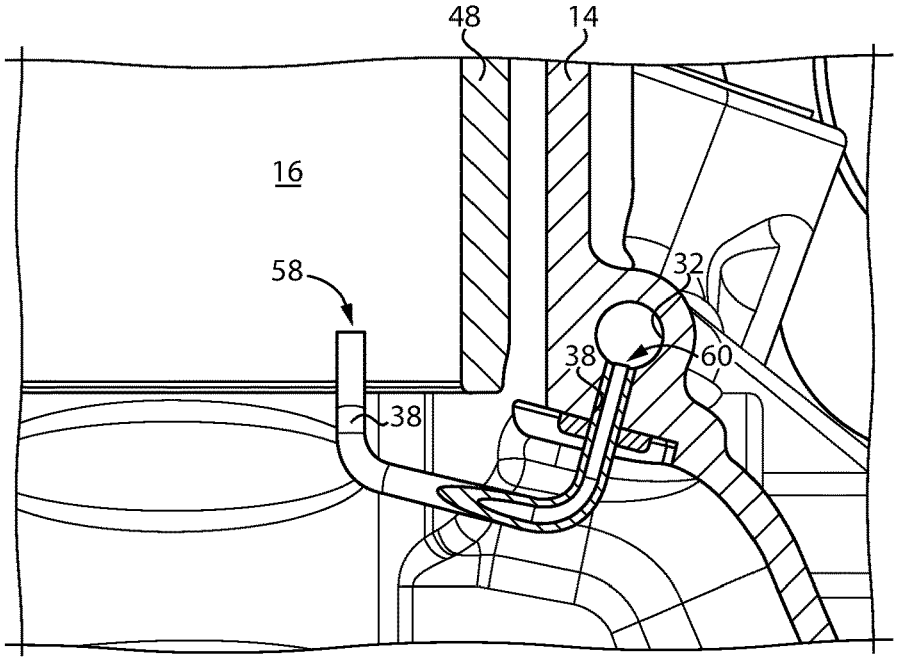
FIG. 4 is another sectioned view through a cylinder block casting as in FIG. 1 and including an oil spray jet.
Figure 5:
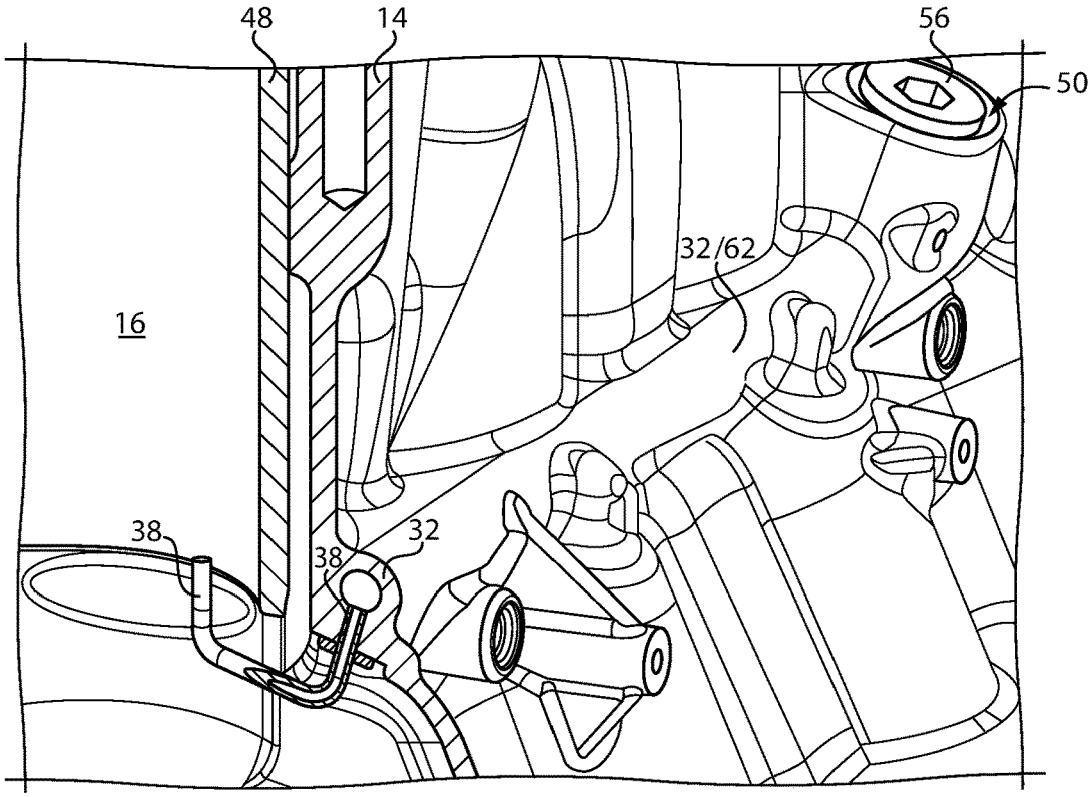
FIG. 5 is another sectioned view through a cylinder block casting as in FIG. 1 and including an oil spray jet.

Engine 10 further includes a plurality of oil spray jets 38 each fluidly connected to, and typically fitted into, one of oil feed holes 34 and oriented to spray oil upwardly into one of cylinders 16. As can best be seen from FIGS. 4 and 5, each of oil spray jets 34 can include an elongate, tubular structure having a jet inlet 60 within an oil feed hole 38, and a jet outlet 58 positioned within a cylinder 16. FIGS. 4 and 5 also illustrate a cylinder liner 48 forming in part the combustion space of the associated cylinder 16.

Figure 6:
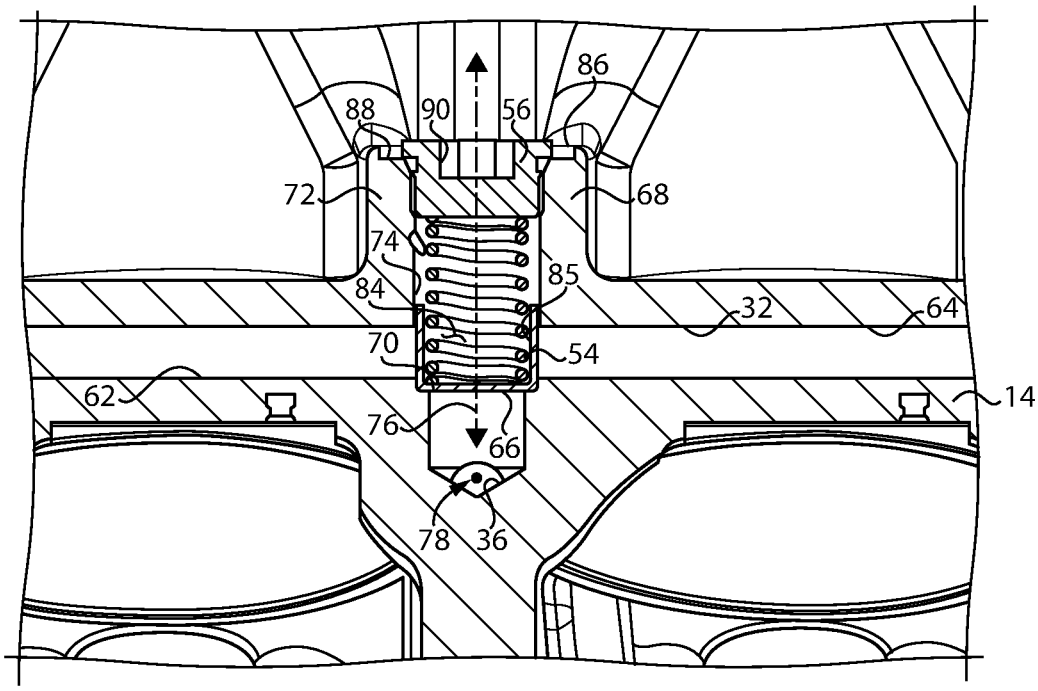
FIG. 6 is another sectioned view through a cylinder block casting as in FIG. 1, and including an oil admission valve.

Engine 10 still further includes an oil admission valve 50 supported in cylinder block 12 and movable between a closed position where oil admission valve 50 blocks spray jet gallery 32 and each of oil feed holes 34 from cross-hole 36, and an open position where oil admission valve 50 does not block spray jet gallery 32 and oil feed holes from cross-hole 36. Oil admission valve 50 may be a three-way valve positioned fluidly between forward segment 62 and back segment 64 of a spray jet gallery 32. Engine 10, and in particular cylinder block casting 14, may further include a cast-in valve body 68. Cylinder block casting 14 further includes an outer casting surface 46 (a block outer surface). Cast-in valve body 68 forms a valve bore 74, and a valve seat 70. Valve bore 74 extends from cross-hole 36 to outer casting surface 46. Valve seat 70 is located fluidly between cross-hole 36 and spray jet gallery 32. Also in the illustrated embodiment cast-in valve body 68 includes a projecting valve boss 72 having a boss end surface 86. Boss end surface 86 extends peripherally around valve bore 74 and forms a part of outer casting surface 46. It can also be seen from FIG. 6 that a recess 88 is formed in valve boss 72.

Figure 7:
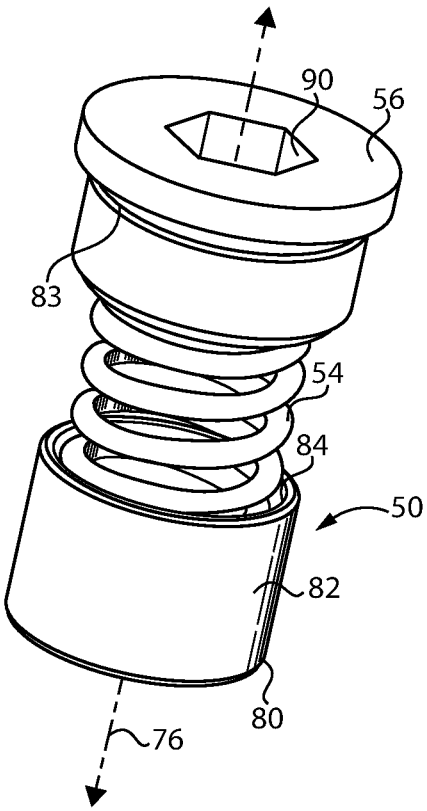
FIG. 7 is a diagrammatic view of an oil admission valve assembly, according to one embodiment.

An oil admission valve according to the present disclosure may be the sole fluid connection control between cross-hole 36 and spray jet gallery 32. As will be further apparent from the following description, oil admission valve 50 may operate passively, in response to an oil pressure supplied by way of cross-hole 36, or actively and be electrically actuated. Referring also now to FIG. 7, engine 10 may further include a spring biaser 54, for example a coil spring, biasing oil admission valve 50 toward the closed position. Oil admission valve 50 may include a valve member 80. Oil admission valve 50, namely valve member 80 in the illustrated embodiment, may include an opening hydraulic surface 66 exposed to a fluid pressure of cross-hole 36. Opening hydraulic surface 66 is in contact with valve seat 70 at the closed position. Oil admission valve 50 is also understood to define a valve axis of reciprocation 76. Valve axis of reciprocation 76 may be colinear with a central bore axis (not numbered) of valve bore 74. Cross-hole 36 also defines a cross-hole center axis 78. Valve axis of reciprocation 76 intersects cross-hole axis 78, as can been seen in FIG. 6, in the illustrated embodiment.

It will be recalled oil admission valve 50 contacts valve seat 70 at the closed position. Opening hydraulic surface 66 may be planar, and valve seat 70 may be a flat seat. In other embodiments a conical opening hydraulic surface and a conical valve seat, spherical surfaces, or still another arrangement and/or structure might be used. A slide-type spool valve, a poppet valve, or still other valve configurations employing one or more valve members, may fall within the scope of the present disclosure. Oil admission valve 50, namely valve member 80 in the illustrated embodiment, includes an outer peripheral surface 82 extending around valve axis of reciprocation 76 and exposed to spray jet gallery 32 at the closed position. Outer peripheral surface 82 can thus be understood to form a wetted surface of forward segment 62 of spray jet gallery 32 and a wetted surface of back segment 64 of spray jet gallery 32, when oil admission valve 50 is at the closed position. Oil admission valve 50, namely valve member 80 in the illustrated embodiment, may also include an inner peripheral surface 85. Inner peripheral surface 85 may also extend around valve axis of reciprocation 76 and forms a spring pocket 84 receiving spring biaser 54. Each of outer peripheral surface 82 and inner peripheral surface 85 may be cylindrical giving valve member 80 a shape akin to a bucket or pail. Oil admission valve 50 may form a valve assembly of valve member 80, spring biaser 54, and a cap 56. Cap 56 may be engaged with cylinder block casting 14, within cast-in valve body 68. In particular, cap 56 may be attached to valve boss 72 within valve bore 74 and engaged by way of threads 83. Threads 83 can include external threads, with valve bore 74 suitably internally threaded. Cap 56 is received partially within recess 88. Tool engagement surfaces 90, for example a conventional female or male socket hex or the like, may be formed on or in cap 56.

Figure 8:
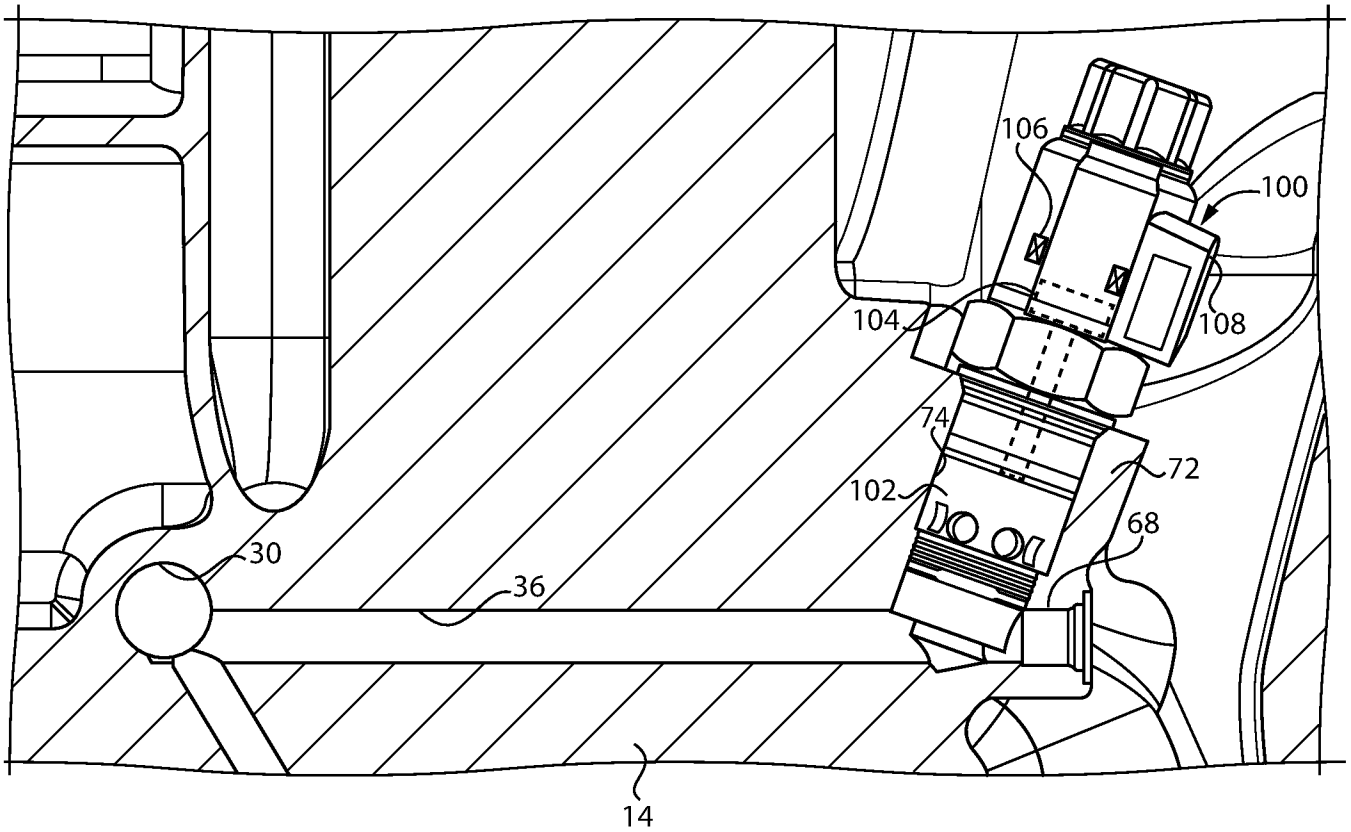
FIG. 8 is a sectioned view through a cylinder block casting including an oil admission valve assembly according to another embodiment.

Referring now to FIG. 8, there is shown cylinder block casting 14 equipped with an electrical actuator 100. It will be appreciated that cylinder block casting is structured for use with either of the oil admission valve configurations and actuation principles discussed herein. Electrical actuator 100 may be attached to valve boss 72 and coupled to an oil admission valve member 102. Oil admission valve member 102 could be similar or identical to admission valve member 80 or could have a different configuration. Electrical actuator 100 includes an armature 104 coupled to valve member 102, a solenoid 106, and an electrical plug or connector 108, for communicatively connecting to an engine control system. Electrical actuator 100 is structured to move oil admission valve/valve member 102 from a closed position to an open position, in a manner functionally analogous to the embodiment described above. In one example, valve member 102 is biased closed with a spring biaser, and electrical actuator 100 is energized to move valve member 102 from a closed position in opposition to a biasing force of the spring biaser. In another implementation electrical actuator 100 moves valve member 102 between stop positions without the assistance of a spring biaser, or valve member 102 could be biased open and electrically actuated to close. It should be appreciated that the present disclosure is not limited with respect to valve configuration or valve operation, contemplating embodiments where an oil admission valve is purely passive, embodiments where an oil admission valve is actuated electrically, or combinations of these strategies.

INDUSTRIAL APPLICABILITY

Referring to the drawings generally, it will be recalled that engine 10 will be equipped with an oil pump. Embodiments are contemplated where a fixed displacement oil pump is employed and operated linearly with engine speed. At a relatively lower engine speed, an outlet pressure of the oil pump will act upon opening hydraulic surface 66, with the outlet oil pressure being conveyed to opening hydraulic surface 66 through main oil gallery 20 and cross-hole 36. At a relatively lower engine speed, however, the oil pressure may not be sufficient to overcome a biasing force of spring biaser 54. As such, spray jet gallery 32 will not be fluidly connected to cross-hole 36, and oil will not spray from oil spray jets 38. When engine speed increases sufficiently, however, an oil pressure acting on opening hydraulic surface 66 will increase to a pressure sufficient to overcome a biasing force of spring biaser 54, and fluidly connect cross-hole 36 to spray jet gallery 32 resulting in initiation of a spraying of oil with oil spray jets 38.

In another embodiment, engine 10 is equipped with an oil pump that can vary its outlet pressure, for example, an inlet metered oil pump, an outlet metered oil pump, or an oil pump otherwise operated to vary an oil outlet pressure. Using an oil pump that varies its outlet pressure independently of engine speed, the oil pump can be operated as desired to increase or decrease oil pressure and thereby control spraying of oil with oil spray jets 38 by hydraulically controlling the opening or closing of an oil admission valve.

Still other embodiments employ an electrical actuator 100. An embodiment employing electrical actuator 100 could be implemented with an oil pump that operates linearly with engine speed, maintaining an oil admission valve closed to prevent oil spray, except at such times where oil spray is desired by electrically actuating the oil admission valve to open. In a still further refinement, an electrical actuator can be used in combination with a variable displacement oil pump not linearly related in operation to engine speed. In this refined embodiment, an optimized flexibility with regard to oil spraying can be realized, with oil spray pressure and oil spray timing capable of being associated without limitation to various different engine operating conditions.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon an examination of the attached drawings and appended claims. As used herein, the articles "a" and "an" are intended to include one or more items, and may be used interchangeably with "one or more." Where only one item is intended, the term "one" or similar language is used. Also, as used herein, the terms "has," "have," "having," or the like are intended to be open-ended terms. Further, the phrase "based on" is intended to mean "based, at least in part, on" unless explicitly stated otherwise.

What is claimed is:

1. An engine comprising:

a cylinder block having formed therein a plurality of cylinders extending between a top deck surface and a bottom block surface, and arranged between a front block end, and a back block end;

the cylinder block further having formed therein a main oil gallery extending longitudinally between the front block end and the back block end, a spray jet gallery, a plurality of oil feed holes fluidly connected to the spray jet gallery, and a cross-hole fluidly connected to the main oil gallery and extending to the spray jet gallery;

a plurality of oil spray jets each fluidly connected to one of the plurality of oil feed holes and oriented to spray oil upwardly into one of the plurality of cylinders;

an oil admission valve supported in the cylinder block and movable between a closed position where the oil admission valve blocks the spray jet gallery and each of the plurality of oil feed holes from the cross-hole, and an open position;

the spray jet gallery includes a forward segment arranged to feed oil to a forward set of the oil feed holes and a back segment arranged to feed oil to a back set of the oil feed holes; and the oil admission valve includes a three-way valve positioned fluidly between the cross-hole and each of the forward segment and the back segment of the spray jet gallery.

2. The engine of claim 1 further comprising a spring biaser biasing the oil admission valve toward the closed position.

3. The engine of claim 2 wherein the oil admission valve includes an opening hydraulic surface exposed to a fluid pressure of the cross-hole.

4. The engine of claim 3 wherein the cylinder block includes a cast-in valve body forming a valve seat, and the opening hydraulic surface is in contact with the valve seat at the closed position.

5. The engine of claim 4 wherein the oil admission valve includes an outer peripheral surface extending around a valve axis of reciprocation and exposed to the spray jet gallery at the closed position.

6. The engine of claim 5 wherein the oil admission valve includes an inner peripheral surface forming a spring pocket receiving the spring biaser.

7. The engine of claim 1 further comprising an electrical actuator coupled to the oil admission valve and structured to move the oil admission valve from the closed position.

8. The engine of claim 1 wherein the cylinder block includes a crankcase, and the main oil gallery is upon a first lateral side of the crankcase and the spray jet gallery is upon a second lateral side of the crankcase.

9. A cylinder block comprising:

a cylinder block casting having formed therein a plurality of cylinders extending between a top deck surface and a bottom block surface, and arranged between a front block end, and a back block end;

the cylinder block casting further having formed therein a main oil gallery extending longitudinally between the front block end and the back block end, a spray jet gallery extending longitudinally between the front block end and the back block end, a plurality of oil feed holes each opening from the spray jet gallery at a location longitudinally aligned with one of the plurality of cylinders, and a cross-hole fluidly connected to the main oil gallery and extending to the spray jet gallery; and the cylinder block casting further including an outer casting surface, and a cast-in valve body forming a valve bore extending from the cross-hole to the outer casting surface.

10. The cylinder block of claim 9 wherein the cast-in valve body forms a valve seat located fluidly between the cross-hole and the spray jet gallery.

11. The cylinder block of claim 10 wherein the valve seat includes a flat seat.

12. The cylinder block of claim 9 wherein the cylinder block casting further forms a crankcase, and the main oil gallery is upon a first lateral side of the crankcase and the spray jet gallery is upon a second lateral side of the crankcase.

13. The cylinder block of claim 9 wherein:

the spray jet gallery includes a forward segment arranged to feed oil to a forward set of the oil feed holes and a back segment arranged to feed oil to a back set of the oil feed holes; and the cross-hole fluidly connects to the spray jet gallery at a location that is longitudinally between the forward set of the oil feed holes and the back set of the oil feed holes.

14. The cylinder block of claim 9 wherein the cross-hole defines a cross-hole center axis, and the valve bore defines a valve bore center axis intersecting the cross-hole center axis.

15. The cylinder block of claim 14 wherein the cast-in valve body includes a projecting valve boss having a boss end surface extending peripherally around the valve bore and forming a part of the casting outer surface.

16. The cylinder block of claim 9 wherein the plurality of cylinders are in an inline arrangement between the front block end and the back block end, and the plurality of oil feed holes are each oriented so as to open downwardly from the oil jet gallery and arranged on-center with the respective one of the plurality of cylinders.

17. An engine comprising:

a cylinder block having formed therein a plurality of cylinders extending between a top deck surface and a bottom block surface, and arranged between a front block end, and a back block end;

the cylinder block further having formed therein a main oil gallery extending longitudinally between the front block end and the back block end, a spray jet gallery, a plurality of oil feed holes each fluidly connected to the spray jet gallery and longitudinally aligned with one of the plurality of cylinders, and a cross-hole fluidly connected to the main oil gallery and extending to the spray jet gallery;

an oil admission valve supported in the cylinder block and movable between a closed position where the oil admission valve blocks the spray jet gallery and each of the plurality of oil feed holes from the cross-hole, and an open position; and the cylinder block further includes a first lateral exterior side and a second lateral exterior side and forms a crankcase, and the main oil gallery is upon a first lateral side of the crankcase closer to the first lateral exterior side of the cylinder block than to the second lateral exterior side of the cylinder block, and the spray jet gallery is upon a second lateral side of the cylinder block closer to the second lateral exterior side of the cylinder block than to the first lateral exterior side of the cylinder block.

18. The engine of claim 17 wherein a total of one oil feed connection extends between the main oil gallery and the spray jet gallery and is formed by the cross-hole.

19. The engine of claim 18 wherein:

the plurality of cylinders are in an inline arrangement between the front block end and the back block end;

the spray jet gallery includes a forward segment arranged to feed oil to a forward set of the oil feed holes and a back segment arranged to feed oil to a back set of the oil feed holes; and the cross-hole fluidly connects to the spray jet gallery at a location that is longitudinally between the forward set of the oil feed holes and the back set of the oil feed holes.

* * * * *